United States Patent [19]

Davis

[11] Patent Number: 4,894,937

[45] Date of Patent: Jan. 23, 1990

[54] SIGN STAKE

[76] Inventor: R. P. Stephen Davis, 434 Mammoth Oaks Dr., Charlotte, N.C. 28226

[21] Appl. No.: 190,670

[22] Filed: May 5, 1988

[51] Int. Cl.[4] ..... G09F 15/00

[52] U.S. Cl. ..... 40/606; 40/611; 248/248

[58] Field of Search ..... 40/610, 607, 606, 611, 40/645, 658, 659; 248/156, 175, 530; 211/59.1

[56] References Cited

U.S. PATENT DOCUMENTS

| | | | |
|---|---|---|---|
| 363,206 | 5/1887 | Burgess, Jr. | 40/659 |
| 2,872,750 | 2/1959 | Holcomb | 40/611 |
| 3,057,093 | 10/1962 | Gallo | 40/645 |
| 4,658,527 | 4/1987 | Pingel | 40/617 |
| 4,660,310 | 4/1987 | Farmer | 40/606 |

OTHER PUBLICATIONS

Paul Irwin Advertising, Advertisement, Aug. 19, 1977.

*Primary Examiner*—Robert P. Swiatek
*Assistant Examiner*—Cary E. Stone
*Attorney, Agent, or Firm*—W. Thad Adams, III

[57] ABSTRACT

A stake for holding a sign upright and comprising at least two parallel and spaced-apart elongate legs, one end of which legs for being driven into the ground and the other end of which legs for supporting a sign above the ground, and at least two longitudinally spaced-apart cross-members secured to and connecting the legs together. At least one of the cross-members comprises a step for being used to drive the two legs into the ground for supporting a sign on the other end. The other end of the legs comprises thin wire-like members for extending into the open areas of a corrugated sign or for holding a fiberboard sign. The other cross-member supports the sign at a predetermined distance above the cross-member which comprises the step.

3 Claims, 1 Drawing Sheet

SIGN STAKE

TECHNICAL FIELD AND BACKGROUND OF THE INVENTION

This invention relates to a stake for holding signs such as real estate, political and other relatively small outdoor signs. Typically such signs are stapled or nailed to wooden stakes which are then driven into the ground using a hammer, mallet or the butt end of an axe. Considerable force is required, especially when the ground is dry or relatively hard, or when the end of the wooden stake has not been properly sharpened.

This invention makes use of a product which has heretofore been used only as masonry reinforcing wire product. The wire product is manufactured in relatively long lengths and is placed between courses of brick or block at predetermined intervals as a wall is being laid. The reinforcing wire adds strength and rigidity to the wall. It has been found that by cutting this wire product into lengths approximately 30" long, a ideal sign stake is thereby formed. A 30" length of the material has two cross-members. One cross-member can be used as a step to drive the stake into the ground with the foot. An axe or hammer is no longer required. The other cross-member holds the sign at the proper location on the stake, thereby eliminating the need to the staple or otherwise affix the sign to the stake. Of course, staples can still be used if desired. The wire is mill galvanized steel and therefore has a long life even in harsh environments.

SUMMARY OF THE INVENTION

Therefore, it is an object of the invention to provide a sign stake which can be driven into the ground without the use of a hammer, axe or the like.

It is another object of the invention to provide a sign stake which easily penetrates the ground and provides a sturdy and durable support for the sign.

It is another object of the invention to provide a sign stake which can be driven into the ground with the foot.

It is another object of the invention to provide a sign stake which is inexpensive and can be used for both corrugated and fiber board signs in a wide variety of sizes.

It is another object of the invention to provide a sign stake which will hold a sign without attachment means such as staples, nails or the like.

These and other objects of the present invention are achieved in the preferred embodiments disclosed below by providing a stake for holding a sign upright and comprising at least two parallel and spaced-apart elongate legs, one end of which legs for being driven into the ground and the other end of which legs for supporting a sign above the ground, and at least two longitudinally spaced-apart cross-members secured to and connecting the legs together.

At least one of the cross-members comprises a step for being used to drive the two legs into the ground for supporting a sign on the on the other end.

The other end of the legs comprise thin wire-like members for extending into the open areas of a corrugated sign. The other cross-member supports the sign at a predetermined distance above the cross-member which comprises the step.

According to one preferred embodiment of the invention, the legs comprise four parallel and spaced apart legs, the legs grouped into first and second pairs of legs with the first and second pairs being spaced further apart from each other than the spacing of the legs comprising each pair.

According to another preferred embodiment of the invention, the first pair of legs are formed to receive one part of the sign therebetween and wherein the second pair of legs are formed to receive a second spaced-apart part of the sign therebetween.

According to yet another preferred embodiment of the invention, three legs are formed to hold the sign with one leg on one side of the sign and the other two legs on the other side of the sign.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
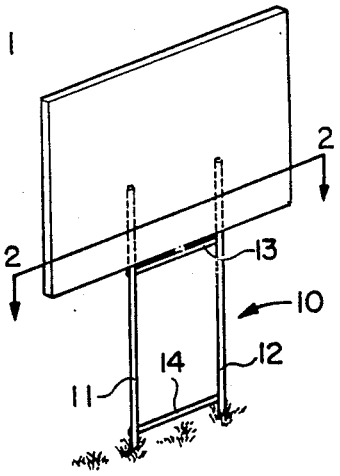
FIG. 1 is a perspective view of one embodiment of the invention.
Figure 2:
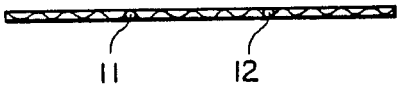
FIG. 2 is a cross-section taken along line 2—2 of FIG. 1.

Referring now specifically to the drawings, a sign stake according to one embodiment of the present invention is illustrated in FIG. 1 and shown generally at reference numeral 10. Stake 10 is formed of a length of masonry galvanized steel reinforcing wire product, and includes two spaced-apart legs 11, 12 connected together by welded cross-members 13 and 14. A suitable length for the stake 10 is 30", with the cross-members 13 and 14 being about 15" apart. The two legs 11, 12 are 10" apart. Stake 10 is particularly suited for use with corrugated signs, which have front and back sign panels with corrugated reinforcement sandwiched between. As is shown in FIG. 2, the upper end of legs 11 and 12 extend up into the corrugated area between the front and back sign panels and hold the sign. The sign is held in the correct position on the stake 10 by the upper cross-member 13, which keeps the sign from sliding any further down the legs 11, 12.

The wire legs 11 and 12 slide very easily into the ground by applying pressure with the foot to the lower cross-member 14.

Figure 3:
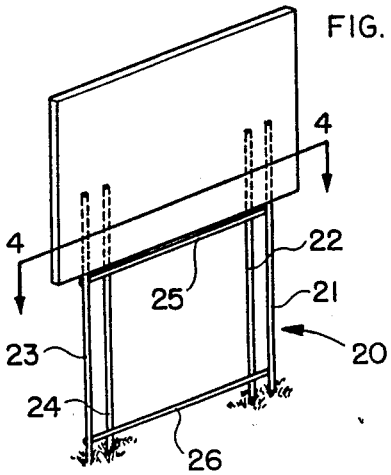
FIG. 3 is a perspective view of another embodiment of the invention.
Figure 4:
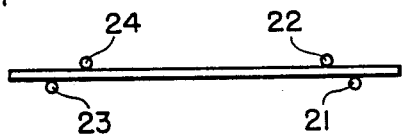
FIG. 4 is a cross-section taken along lines 4—4 of FIG. 3.

Referring now to FIG. 3, a stake 20 is shown and comprises two pairs of legs 21, 22 and 23, 24 connected together by welded cross-members 25 and 26. Stake 20 is most suitable for paperboard and fiberboard signs, which can be held between the upper ends of the pairs of legs 21, 22 and 23, 24, in the manner shown. The upper cross-member 25 positions the sign at the proper position in relation to the stake 20. The lower cross-member 26 is used to insert the stake 20 into the ground by pressure exerted with the foot. To facilitate placement of the sign, cross-member 25 can be bent slightly between legs 21 and 22, and between legs 23 and 24 so that the sign will fit between both pairs of legs in a straight line without bending, as is shown in FIG. 4.

Figure 5:
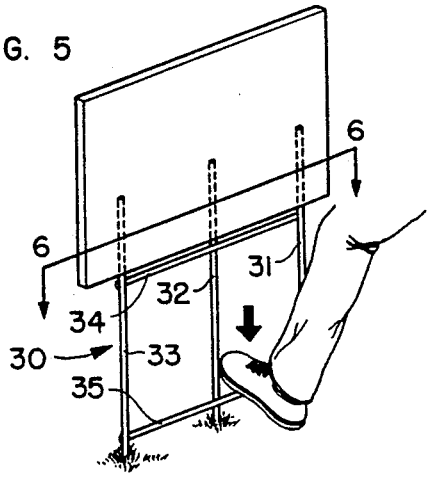
FIG. 5 is a perspective view of yet another embodiment of the invention.

As is shown in FIG. 5, a stake 30 comprises three legs 31, 32, 33 connected together by welded cross-members 34, 35. The upper cross-member 34 positions the sign at the proper position in relation to the stake 30. The lower cross-member 35 is used to insert the stake 30 into the ground by pressure exerted with the foot.

Figure 6:
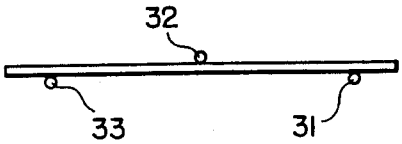
FIG. 6 is a cross-section taken along lines 6—6 of FIG. 5.

To facilitate placement of the sign, cross-member 34 can be bent slightly between legs 31 and 32, and between legs 32 and 33 so that the sign will fit between legs 31, 32 and 33 in a straight line without bending, as is shown in FIG. 6.

The galvanized steel construction of the stakes 10, 20 and 30 permits them to be used repeatedly for an extended period of time. The stakes are lightweight and rustproof. Since no attachment by staples or nails is necessary, no deteriorization occurs, as is the case with wood. If desired, ⅜" or other suitable staples can be used to bind the sign to the stakes.

A wire stake for holding signs is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. A stake for holding a sign upright above a ground surface and comprising:

(a) at least two parallel and spaced-apart elongate wire-like legs having opposed free ends, one free end of which legs for being driven into the ground and the other free end of which legs for supporting a sign above the ground, said sign being of the type having a pair of sign faces separated by a corrugated spacer defining open areas extending vertically as the sign is oriented to the ground for receiving therein said other free ends of said legs;

(b) at least two longitudinally spaced-apart cross-members secured to and connecting said legs together;

(c) at least one of said cross-members comprising a step for being used to drive the two legs into the ground for supporting a sign on the other end thereof, and the other of said cross-members for supporting the sign at a predetermined distance above the cross-member which comprises the step.

2. A stake according to claim 1, wherein said legs comprise four parallel and spaced apart legs, said legs grouped into first and second pairs of legs with said first and second pairs being spaced further apart from each other than the spacing of the legs comprising each pair.

3. A stake according to claim 1, and comprising a third leg.

* * * * *